US008127895B2

(12) United States Patent
Keating

(10) Patent No.: US 8,127,895 B2
(45) Date of Patent: Mar. 6, 2012

(54) DEVICE FOR A SKATEBOARD

(76) Inventor: Martin Keating, London (GB)

( * ) Notice: Subject to any disclaimer, the term of this patent is extended or adjusted under 35 U.S.C. 154(b) by 1212 days.

(21) Appl. No.: 11/816,231

(22) PCT Filed: Feb. 17, 2006

(86) PCT No.: PCT/GB2006/000577

§ 371 (c)(1),
(2), (4) Date: Aug. 14, 2007

(87) PCT Pub. No.: WO2006/087573

PCT Pub. Date: Aug. 24, 2006

(65) Prior Publication Data

US 2008/0156599 A1 Jul. 3, 2008

(30) Foreign Application Priority Data

Feb. 17, 2005 (GB) ..... 0503360.0

(51) Int. Cl.
*A63C 17/00* (2006.01)

(52) U.S. Cl. ..... 188/5; 280/285

(58) Field of Classification Search ..... 280/87.041, 280/87.042, 825; 188/1.12, 19, 32, 84, 265, 188/5; D12/202, 204, 400; *A43B 5/16*
See application file for complete search history.

(56) References Cited

U.S. PATENT DOCUMENTS 3,861,697 A * 1/1975 Dolce ..... 280/825

(Continued)

FOREIGN PATENT DOCUMENTS

DE 2735984 2/1979

*Primary Examiner* — Robert Siconolfi
*Assistant Examiner* — Stephen Bowes
(74) *Attorney, Agent, or Firm* — Luedeka Neely Group, P.C.

(57) ABSTRACT

A braking device removably attachable to a skateboard having a plurality of wheels, the device comprising a plurality of wheel engaging means, each for engaging a wheel of a skateboard, said device being operable to restrain the wheels against rotation relative to the skateboard.

5 Claims, 1 Drawing Sheet

U.S. PATENT DOCUMENTS 3,898,749 A * 8/1975 Famolare, Jr. ..... 36/100
4,003,582 A 1/1977 Maurer
4,161,323 A 7/1979 Wetteland
4,166,516 A 9/1979 Thurmond, Jr.
4,179,134 A 12/1979 Atkinson
4,364,187 A * 12/1982 Melendez ..... 36/15
4,413,842 A * 11/1983 Loredo ..... 280/825
5,119,277 A * 6/1992 Copley et al. ..... 362/543
5,236,224 A * 8/1993 Anderson et al. ..... 280/825
5,549,331 A * 8/1996 Yun et al. ..... 280/843
5,924,733 A * 7/1999 Palleschi ..... 280/825
6,079,747 A * 6/2000 Winsor ..... 280/825
2002/0163144 A1 11/2002 Guerra
2003/0186785 A1 10/2003 Desberg et al.
2005/0040638 A1 2/2005 Riley et al.

* cited by examiner

DEVICE FOR A SKATEBOARD

CROSS REFERENCES TO RELATED APPLICATIONS

This patent application claims priority under all applicable statutes and acts including, but not limited to 35 U.S.C. §§119 (a)-(d) and 120, and is related to Patent Cooperation Treaty (PCT) Patent Application Serial No. PCT/GB2006/000577 filed 17 Feb. 2006, entitled: "Device for a Skateboard." This patent application also claims priority under and is also related to Great Britain Patent Application Serial No. GB0503360.0 filed 17 Feb. 2005, entitled: "Device for a Skateboard." These related Patent Applications are incorporated by reference in their entirety herein.

FIELD

The present invention relates to braking devices suitable for use with skateboards.

BACKGROUND

Skateboarding in its various forms has been around since about the mid-twentieth century. A skateboard generally comprises a 'deck', upon which the skateboarder can stand and wheels attached by means of so-called 'trucks' to the underside of the deck. A deck commonly has a raised portion at one or both ends, which is useful when performing tricks as explained below. A skateboard is commonly ridden by placing a foot on the skateboard deck and by intermittently pushing off the ground with other foot the skateboard is propelled along. Once the skateboard is travelling, or rolling, at a sufficient speed, i.e. with sufficient momentum to travel a satisfactory distance, both feet rest on the deck to aid balance and help control the direction of travel. A skateboard is usually slowed by slowly depressing the back of the skateboard such that a padded plastic or rubber block attached to the underside of the back of the deck makes contact with the ground.

One of the skills a skateboarder can acquire is an ability to perform tricks with a skateboard. Such tricks are often performed from a starting position, in which the skateboarder rests both feet on the stationary deck. By depressing the back raised portion of the skateboard with the back foot, the skateboard pivots on its back wheels, and, if the skateboarder then quickly shifts his or her weight in the correct way towards the front of the board, the skateboard can be propelled into the air. Tricks may be performed while the skateboard is moving or from a standstill. The ability to perform tricks, especially those of a complicated nature, naturally takes some time and much practice to acquire.

It is not always possible or convenient to find an open space for practicing tricks. In enclosed spaces, such as a room of a house, it is often not practical to perform tricks, largely because the skateboard can roll on its wheels, which can damage objects in a room. For a beginner skateboarder, there is also a risk of injury if the skateboard rolls at an inopportune moment while performing, or trying to perform, a trick. This problem has been overcome in one device called a 'soft truck', as described in U.S. Pat. No. 6,805,658. Soft trucks are designed to be attached to a board in place of the wheeled trucks (trucks having wheels rotatably attached thereto). Soft trucks have no wheels, but generally have a similar shape to a truck with wheels. Thus, when the wheeled trucks are replaced by soft trucks, a skateboarder can practice tricks on the skateboard without the board rolling, but the board as a whole still has an approximate shape and weight distribution of a board with wheeled trucks.

Soft trucks, however, have a disadvantage in that the removal of the wheeled trucks and attachment of the soft trucks is time consuming and requires tools for unscrewing and tightening nuts and bolts which connect the wheeled-trucks or the soft trucks to the deck.

It is an aim of the present invention to overcome or substantially mitigate at least some of the problems associated with the prior art.

SUMMARY

In one embodiment the present disclosure provides a braking device that is removably attachable to at least two wheels of a skateboard having a plurality of wheels. The braking device has a plurality of wheel engaging means, each for engaging a wheel of a skateboard. The device is operable to restrain the wheels against rotation relative to the skateboard, and the wheel engaging means includes a loop of resilient material engageable around a portion of the tread of a wheel.

DETAILED DESCRIPTION

The present invention provides a braking device removably attachable to a skateboard, preferably the wheels of a skateboard, the skateboard having a plurality of wheels, said device comprising a plurality of wheel engaging means, each for engaging a wheel of a skateboard, said device being operable to restrain the wheels against rotation relative to the skateboard.

The braking device is preferably removably attachable to at least two wheels of the skateboard, more preferably four wheels of the skateboard. Preferably each of the wheel engaging means is attachable to a wheel of a skateboard. Preferably the device comprises four wheel engaging means, each of which is attachable to a wheel of a skateboard.

"Skateboard" includes, but is not limited to, classically shaped skateboards, snakeboards and longboards.

An advantage of the present invention is that it can be fitted to an existing skateboard, without the need for removing the trucks. This therefore makes the device far more efficient to use than the soft trucks of the prior art. Preferably, the device, in use, prevents connection of the wheels with the ground when the skateboard rests on its wheels.

The wheel engaging means may be connected to one another and, in use, exert a tension between the wheel engaging means. If the wheel engaging means are connected in this way, this has the advantage that the device may be adapted so that it attaches only to the wheels, and thus is easily fitted and removed. Preferably therefore the device is connectable only to the wheels of the skateboard, i.e. it is not attached to the deck, trucks or any other part of the skateboard.

The wheel engaging means may be formed from a resilient material and be frictionally engagable with a wheel.

The wheel engaging means may comprise a loop of resilient material engagable around a portion of the tread of a wheel. Preferably the wheel-engaging portions are removably attachable to a wheel of a skateboard.

The device may comprise one or more connecting members that connect the wheel engaging means and the connecting member(s) may be integrally formed with the wheel engaging means. Preferably the device comprises a single connecting member. If the wheel engaging means and the connecting member are integrally formed, this has the advantage that the device can be efficiently produced in a process such as injection moulding.

If the device, or part of the device such as the wheel engaging means or connecting member if present, is formed from a resilient material, preferably the resilient material has an elasticity of at least 10%, more preferably 10 to 25%, even more preferably, an elasticity of 15 to 20%. "Elasticity", indicates the resilient material will deform when stretched in a certain direction at 25° C. to a maximum of n % of its resting length in that dimension. It has been surprisingly found that a material having an elasticity within these ranges is sufficiently flexible for making a device which in use exerts sufficient tension on the wheels to prevent rotation of the wheels and, if the wheel engaging means are in the form of loops, the device can be easily attached to or removed from a wheel.

The device may comprise two or more wheel engaging means, preferably four wheel engaging means, or a wheel engaging means for each wheel of a skateboard. The device may prevent a skateboard moving to a certain extent if it engages only two wheels, but it has been found that all wheels of a skateboard should be engaged and prevented from moving for improved control of the skateboard when performing tricks.

Accordingly, in a preferred embodiment of the invention, the braking device comprises four wheel engaging means, each defining a loop, or cavity having an aperture, which can accept a wheel, and a connecting member connecting said wheel engaging means, wherein the wheel engaging means and connecting member are integrally formed from a resilient material, preferably having a Shore A Hardness of from 50 to 80, and the device is removably attachable to the skateboard by placing each wheel engaging means over a wheel such that when attached, a tension is exerted between each of the wheel engaging members to restrain the wheels from rotating. The resilient material preferably has an elasticity of from 10% or more, more preferably 10 to 25%.

If the wheel engaging means each define a loop, preferably the thickness of the material that, in use, would be disposed between the ground and the wheel of a skateboard is no thicker than approximately 20 mm, more preferably 5 mm.

Preferably, the device is an integrally moulded device comprising a resilient material, preferably a natural or synthetic rubber material.

Preferably the resilient material is selected from one or more of (i) a silicone rubber, such as Wacher ELN 4601, (ii) a neoprene, such as Neoprene polychloroprene or Neoprene C34, and (iii) polyurethane. Most preferably, the resilient material comprises polyurethane.

The resilient material preferably has a Shore "A" Hardness of from 50 to 80, more preferably of from 60 to 70, the Hardness being determined in accordance with BS EN ISO 868:2003. Such a material has been found to have an optimum resilience and durability during use of the device on the skateboard while the device can still being easily attached and removed from the skateboard by hand.

Preferably the device comprise polyurethane having a Shore "A" Hardness of from 50 to 80.

The device preferably has an elongate central connecting member having a width, measured in a width direction of the skateboard when the device is attached to the skateboard, that is less than the distance between the outer rims of wheels on the same truck, more preferably less than the distance between the inner rims of the wheels of the same truck. Preferably, elongate central member has a width of from 5 to 15 cm. Four lobes that each form a wheel engaging means preferably extend away from the elongate central member and can each accept a wheel, such that when the device is attached each wheel is restrained from rotating relative to the skateboard. Preferably, the elongate connecting member has an appropriate length and the lobes extend at an appropriate angle such that any nuts that present on the underside of the truck are accessible when the device is attached to the skateboard. The length of the connecting member is preferably of from 32 to 42 cm, preferably 35 to 37 cm. The ideal length will be dictated by the distance between the front and back wheels of the skateboard. The lobes preferably extend from each end of the central connecting member at an approximate angle of about 30 to 60 degrees, said angle being the angle between a length direction of the device (0 degrees) and the direction through the centre of the lobe. The angle is preferably about 40 to 50 degrees, preferably about 45 degrees. Such a device may overall have a 'bone' shape. It has been surprisingly found that a device having a central connecting member with lobes extending away therefrom, as described above, is an economic method of making the device, since the amount of material required to make the device can be reduced, while still maintaining both the required strength of the device and, in use, the tension between the wheel engaging members to restrain the wheels from rotating.

The total length of the device, in use, (measured along the length of the skateboard from one wheel engaging means to another) may be 1 to 5 cm greater than the same length when the device is not attached to the skateboard.

The present invention will now be further illustrated, by way of example only, with reference to the following drawings, in which.

EXAMPLE 1

Figure 1:
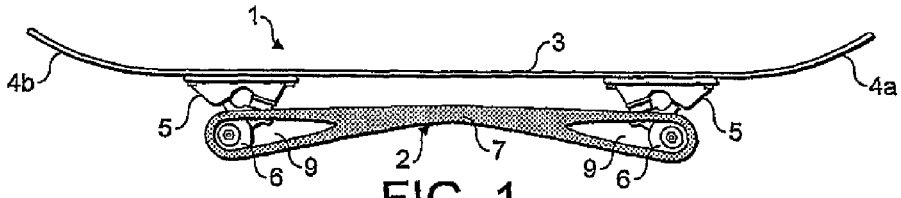
FIG. 1 shows a side view of a first embodiment of the device attached to a skateboard.
Figure 2:
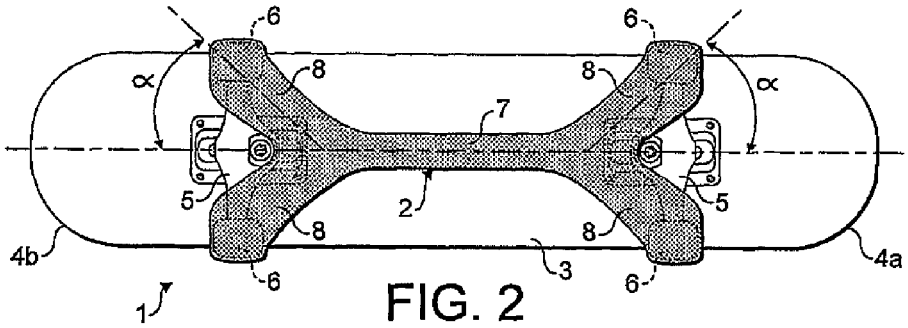
FIG. 2 shows a view of the underside of FIG. 1.
Figure 3:
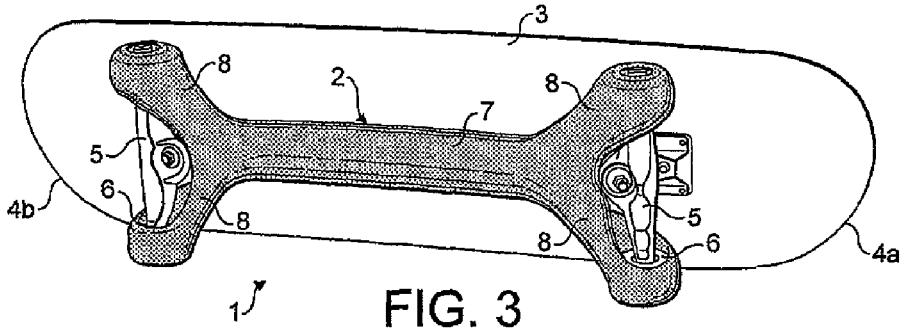
FIG. 3 shows a perspective view of FIG. 1.

FIGS. 1 and 2 show a skateboard 1 attached to a braking device 2 in accordance with a first embodiment of the invention. The skateboard comprises a deck 3 with raised portions 4*a*, 4*b* at either end. Trucks 5 are disposed on the underside of the deck 3 towards the front and rear of the board. As used herein, a truck indicates a mounting bracket attachable to a skateboard and having an axle for notably carrying a pair of wheels. Two wheels 6 are rotatably attached to the axle (not shown) on each truck 5. The braking device 2 is an integrally moulded single piece of resilient material such as Neoprene C34 or polyurethane having a Shore "A" Hardness of from 50 to 80. The device comprises a central body section (connecting member) 7, extending from which, at an approximate angle $\alpha$ (of 45 degrees, are lobes 8, each of which defines a cavity 9 which accepts and frictionally engages with one wheel of the skateboard. The lobes and cavities therein essentially form loops as best seen in FIG. 1. The device of FIG. 2 is shown, for illustration purposes only, as being transparent such that the positioning of the wheels within the device can be clearly seen. The device may be made of transparent, translucent or opaque material. The device shown in FIG. 3 is shown to be made of an opaque material.

Attachment and removal of the device requires no tools. The device 2 can be attached to the skateboard 1 in the following simple manner. First, two lobes in the form of loops 8 at one end of the device are fitted over the wheels 6 on one truck 5, such that the wheels 6 reside in the cavities 9. The device 2 is then stretched such that the remaining free loops 8 can be slid or placed over the wheels 6 on the other truck 5 to reside in the remaining cavities 9. The elasticity and dimensions of the device 2 ensure frictional engagement of the interior surface of the lobes 8 with the wheels 6 sufficient to substantially prevent rotation of the wheels 6. The skateboard 1 can then be used to practice tricks and, due to the device being attached to, and preventing movement of, the wheels, the board 1 does not roll.

The length of the device 2 on attachment corresponds approximately to the distance along the length of the skateboard from the front surface of one wheel to the rear surface of a wheel on the other truck. The width of the device on attachment corresponds to the distance between the outer rims of the wheels 6 on a truck 5. When not attached to the wheels 6 the length and width are slightly less than when attached due to the elastic nature of the material. When in position on a conventional board, the device overall may be about 54 cm in length (A) and about 19 cm in width (B). The central connecting member may have, when in position on a conventional board, a length of approximately 35 cm.

EXAMPLE 2

Figure 4:
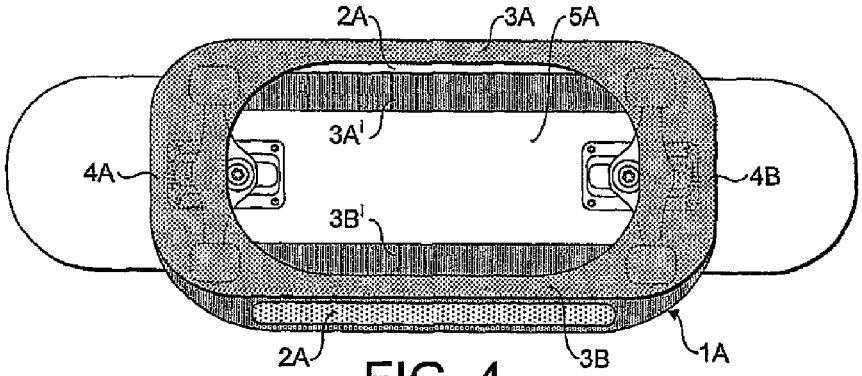
FIG. 4 shows a second embodiment of the device attached to a skateboard viewed from the underside of the skateboard.

FIG. 4 illustrates a second embodiment of the invention in position on a skateboard. The device 1A has been formed from a small car's rubber inner tube, i.e. a single tyre-shaped piece of rubber, having two opposing portions removed from the 'tread' an inner tube to form holes 2A. As can be seen from this figure, at each end of the device, the wheel engaging means defines a cavity, which accepts two wheels. The two ends of the device 4A, 4B are connected to one another by two pairs of connecting members (3A, 3A'), (3B, 3B') each pair, in use, extending along the length of the skateboard in approximate line with the outer rims of the wheels (not visible in FIG. 4). Each pair of connecting members has an upper connecting member (3A')/(3B') and a lower connecting member (3A)/(3B). "Upper" and "lower" is relative to the floor when the device is attached to a skateboard and the skateboard is resting on the ground on its wheels.

The device of FIG. 4 is attached to the skateboard by inserting the left hand wheels through an aperture 5A, formed between the upper connecting members, 3A' and 3B', and positioning the wheels in the cavity formed at the end 4A of the device. The connecting members of the device are then stretched to allow the remaining free wheels (the right hand wheels, not shown in FIG. 4) to be inserted through the aperture 5A and positioned in the cavity at the end of the device 4B. The elasticity and dimensions of the device 1A ensure frictional engagement of the interior surface of the ends 4A, 4B of the device with the wheels sufficient to substantially prevent rotation of the wheels. The device can be easily removed by stretching the connecting members of the device such that the wheels can be removed from the device through aperture 5A.

The embodiment of Example 1 is preferred over the embodiment of Example 2, which represents an early prototype of the present invention, since it comprises only a single central connecting member, rather than four, and as such is more economical and efficient to produce, while still maintaining sufficient tension between the lobes to prevent the wheels from rotating relative to the skateboard. Additionally, the embodiment of Example 1 allows access to the nuts on the underside the truck. When the device of Example 1 is attached to the board, the board as a whole has a shape closer to that of a board without the device, compared to a board attached to the device of Example 2. The bone shape of the device in Example 1 is particularly preferred over the device of Example 2, since its single centrally positioned connecting member is much less likely to interfere with a user when he/she performing tricks with a skateboard, to which the device is attached. The bone shape also has an advantage that it conserves the amount of material required to produce the device, when compared with a device such as that in Example 2.

What is claimed is:

1. A device removably attachable to a skateboard for use on a ground surface, the skateboard having a length direction and a width direction and a first wheel and second wheel, wherein the second wheel is offset in the width direction from the first wheel, and a third wheel and a fourth wheel, wherein the fourth wheel is offset in the width direction from the third wheel, and wherein the first and second wheels are offset in the length direction from the third and the fourth wheels and each wheel has a tread, the device comprising:

four lobes, each lobe having an inner surface for engaging at least a portion of the tread of a different one of the four wheels of the skateboard and each lobe having an outer surface portion formed as a circular arc with a mid-point that engages the ground surface; and a central connecting member having a centroid and interconnecting the four lobes to restrain a rotation of the wheel with which that lobe is engaged, wherein the central connecting member and the four lobes are formed of a resilient material such that tension is exerted between the four lobes and the central connecting member to restrain a rotation of the wheel with which that lobe is engaged and to urge each of the wheels toward the centroid of the central connecting member, wherein the lobes are disposed angularly from the central member.

2. The device as claimed in claim 1, wherein the central connecting member is integrally formed with the four lobes.

3. The device as claimed in claim 1, wherein the resilient material has a Shore A Hardness in a range from 50 to 80.

4. The device as claimed in claim 1 wherein the resilient material has an elasticity in a range from 10% to 25%.

5. The device of claim 1 wherein the lobes are disposed angularly from the central connecting member at an angle in a range from thirty degrees to sixty degrees.

* * * * *